US005550926A

United States Patent [19]

Tsao

[11] Patent Number: 5,550,926

[45] Date of Patent: Aug. 27, 1996

[54] OVERLAP SOUND CASE

[76] Inventor: Ye-Ming Tsao, 6-4 Fl., No. 188, Sec. 3, Ting-Chou Rd., Taipei, Taiwan

[21] Appl. No.: 302,305

[22] Filed: Sep. 8, 1994

[51] Int. Cl.[6] ..... H04R 25/00

[52] U.S. Cl. ..... 381/188; 381/205; 181/199

[58] Field of Search ..... 381/188, 152, 381/153, 154, 158, 159, 205, 87, 88, 89, 90; 181/156, 199; 248/176.1; 312/107, 198; 446/117, 69

[56] References Cited

U.S. PATENT DOCUMENTS

| | | | |
|---|---|---|---|
| 3,985,200 | 10/1976 | Sepmeyer | 181/199 |
| 4,591,020 | 5/1986 | Hruby, Jr. | 181/150 |
| 4,699,601 | 10/1987 | Hershfeld | 446/117 |

*Primary Examiner*—Curtis Kuntz
*Assistant Examiner*—Huyen D. Ie
*Attorney, Agent, or Firm*—Pro-Techtor International

[57] ABSTRACT

An overlap sound case composes of a main sound case which contains speakers and the required electric circuit, and a plural number of subordinate sound chests. A subordinate sound chest is a hollow tube and is in different size sequentially such that the main sound case and all other subordinate sound chests can be housed within the largest subordinate sound chest to facilitate moving or storage. When in use the main sound case is disposed on top of a small subordinate sound chest which in turn is disposed on top of a larger subordinate sound chest to form a pagoda like sound case assembly, Thus to enhance low frequency resounding quality. The main sound case and each subordinate sound chest have an opening formed on the bottom wall, have a connection recess formed on the top of a side wall and have a protrudent flange formed outwardly at each side of the bottom wall.

6 Claims, 4 Drawing Sheets

OVERLAP SOUND CASE

BACKGROUND OF THE INVENTION

1. Field of the Invention

The present invention relates to an overlap sound case and particularly to a sound case which composes of a main sound case and a plural number of subordinate sound chests that can be easily assembled or withdrawn.

2. Description of the Prior Art

Most people have some mysterious feeling about sound as it cannot be seen or touched. When selecting sound case, most people also tend to believe in old brand name or well-known brand name. For decades the main body of sound case has not changed much. In the market place today, the design of sound case is mainly focused in individual unit and the structure and material of sound case. However the resounding quality of a sound case is generally determined according to the quality of signal source, speaker and sound chest which applying resonance principle.

When a sound case is damage in any part, it cannot be replaced, and the value of the whole system is depreciated. In general, the resonant effect of a sound case can be enhanced by increasing its sound wave resonant space or improving the structure of its individual unit. Although a large resonant space can create better resounding quality, it occupies large room and is not convenient to carry. Small sound case cannot produces high efficiency resonance unless it is an improved high efficiency unit, however it has the advantage of good portability and occupying small space. Furthermore, conventional sound case has fixed height, cannot be changed to match different environments. It is not flexible or adaptable. In addition, the design of resonant space is also a factor should be carefully considered. The issues set forth above indicate that the design of sound case need a lot of considerations. The present invention, by providing an overlap sound case, contemplates to resolve the shortcomings of conventional sound case, and to meet people's requirements nowadays.

SUMMARY OF THE INVENTION

It is the primary object of the present invention to provide an overlap sound case which has a plural number of subordinate sound chests to match a main sound case, thereby to increase the resonant space when in use and to create better resounding quality.

It is another object of the present invention to provide an overlap sound case which can be withdrawn quickly to facilitate carry, installation or storage. And also to reduce storage room.

It is a further object of the present invention to provide an overlap sound case which can be made in a variety of multiple elements composition such as two-piece type, three-piece type, four-piece type, etc.

It is yet another object of the present invention to provide an overlap sound case whereby a sound discharge opening is formed at an eccentric location on the bottom wall of a sound case to allow downward sound transmission and resonance. The number of sound discharge opening can be one or more than one.

It is still another object of the present invention to provide an overlap sound case in which a sound discharge opening is formed at appropriated location on all walls of a sound case.

BRIEF DESCRIPTION OF THE DRAWINGS

Additional objects and advantages of the present invention are made apparent in the following description having reference to the accompanying drawings. The accompanying drawings are only to serve for reference and illustrative purpose, and do not intend to limit the scope of the present invention.

DETAILED DESCRIPTION OF THE PREFERRED EMBODIMENTS

Figure 1:
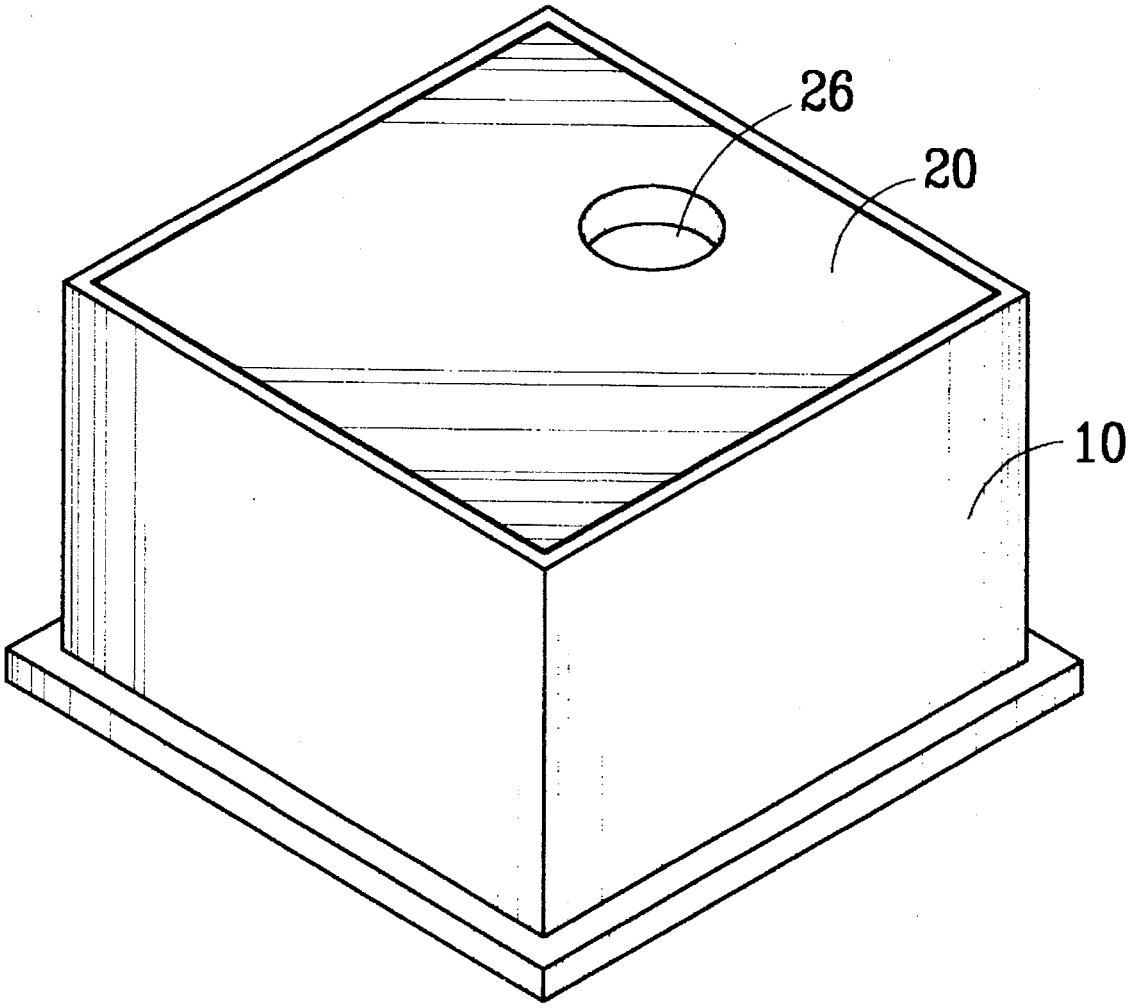
FIG. 1 is a perspective view of the present invention after being withdrawn.
Figure 2:
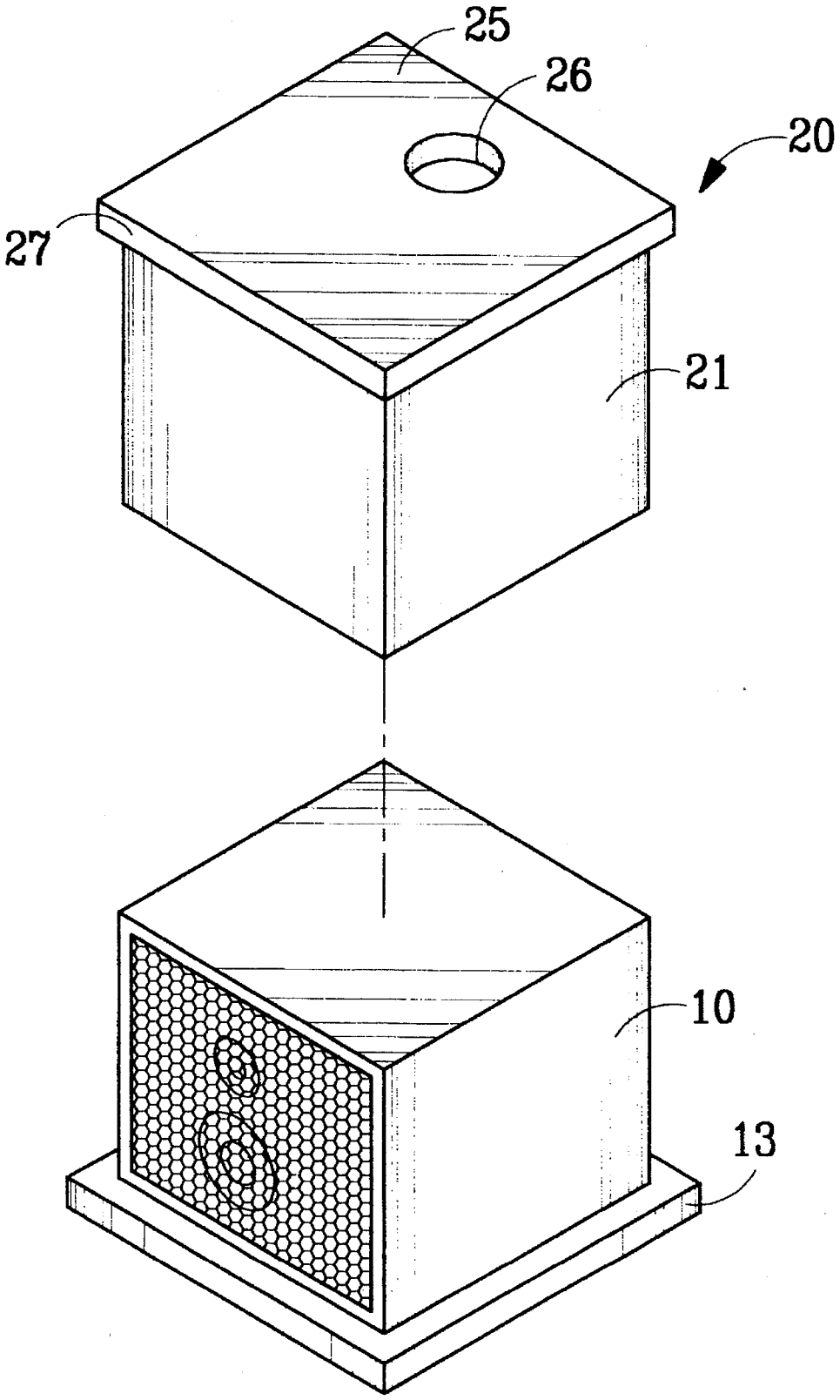
FIG. 2 is an exploded view of an embodiment of a two-piece type of the present invention.
Figure 3:
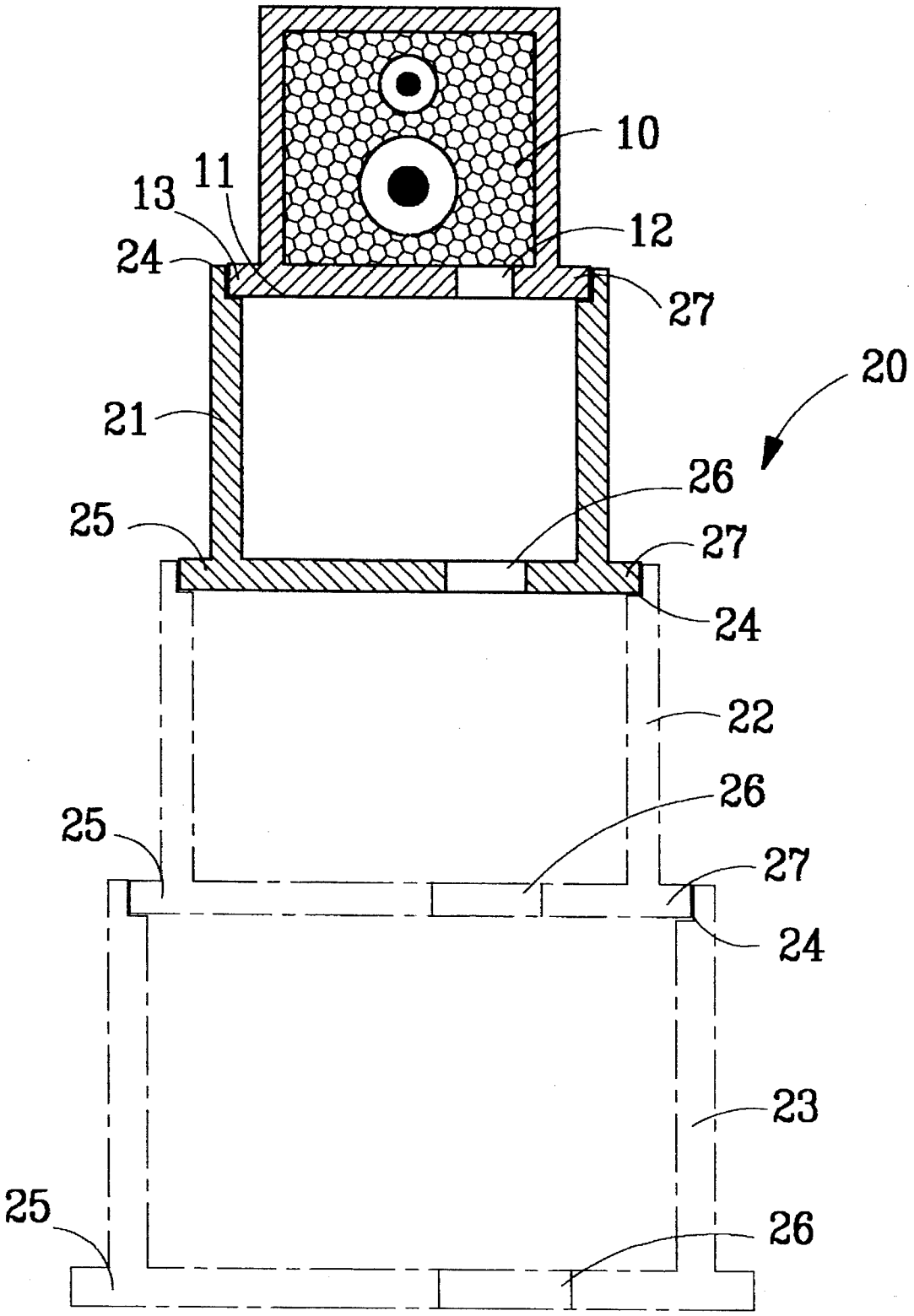
FIG. 3 is a fragmentary section view of an embodiment of a four-piece type of the present invention after being extended.

Referring to FIG. 1, 2, 3 and 4, an overlap sound case of the present invention composes of a main sound case 10 which has speakers and electric circuits disposed therein, and an assembly of subordinate sound chests 20. Subordinate sound chest assembly composes of one or more sound chests. A two-piece type has only one subordinate sound chest 21. A three-piece type has a first-subordinate sound chest 21 and a second-subordinate sound chest 22. A four-piece type has a first-subordinate sound chest 21, a second-subordinate sound chest 22 and a third-subordinate sound chest 23.

The number of subordinate sound chest can be increased if needed. Whatever the number of sound chest, the structure is same as that of a two-piece type. Therefore a two-piece type embodiment will be described in detail hereunder as a representation of all other embodiments.

Subordinate sound chest 21 is a hollow box type means. It can be in square, rectangular or other shapes. However rectangular shape is most commonly used. The size of a subordinate sound chest increases sequentially, i.e. the second-subordinate sound chest 22 is bigger than the first-subordinate sound chest 21. The outside decimeter of the first-subordinate sound chest 21 equals the inside diameter of the second-subordinate sound chest 22. The inside diameter of the first-subordinate sound chest 21 equals the outside diameter of the main sound case 10. Thereby when to withdraw for storage, main sound case 10 is fully contained within the first-subordinate sound chest 21, and the first-subordinate sound chest 21 is fully contained within the second-subordinate sound chest 22 (referring to FIG. 4).

There is an opening 12 formed on the bottom wall 11 of the main sound case 10. A product flange 13 is formed at the outside edge of bottom wall 11. Each subordinate sound chest has a connection recess 24 formed at the top of an inside wall, and has an opening 26 formed on the bottom wall 25, and has a protrudent flange 27 formed at the outside edge of bottom wall 25. Thus forming the main structure of the present invention (referring to FIG. 1 and 2).

Figure 4:
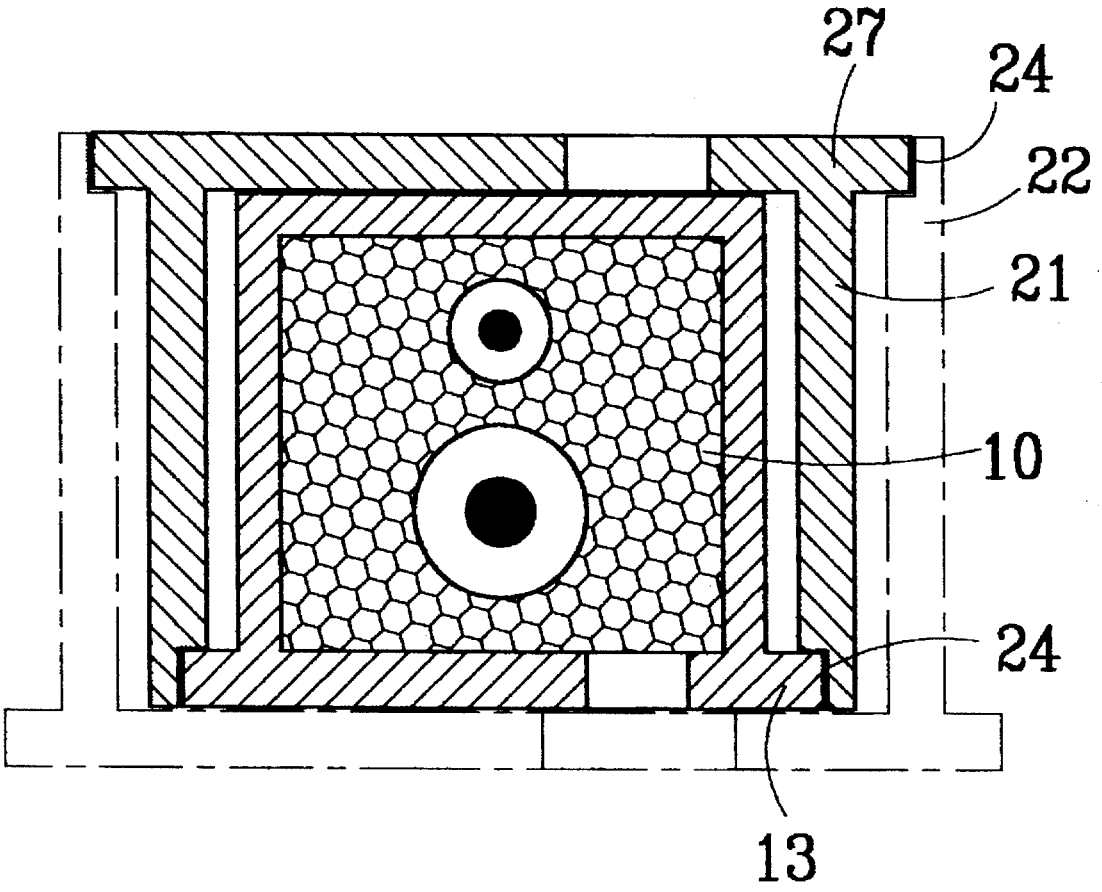
FIG. 4 is a fragmentary section view of an embodiment of a three-piece type of the present invention after being withdrawn.

Referring to FIG. 1 and 4 for the withdrawn state of the present invention. The first-subordinate sound chest 21 is placed upside-down and fully covers the main sound case 10. Protrudent flange 13 of main sound case engages with connection recess 24 of the first-subordinate sound chest 21. Then the main sound case 10 and the first-subordinate sound chest 21 are disposed into the second-subordinate sound chest 22. The protrudent flange 27 of the first-subordinate sound chest 21 engages with a connection recess 24 of the second-subordinate sound chest 22. The procedures set forth above is repeatedly performed until all subordinate sound chests are withdrawn such as FIG. 1 illustrates. It becomes compact and is easy for movement or storage.

To change from withdrawn state (shown in FIG. 1) to extended state (shown in FIG. 3), the most outside subordinate sound chest (e.g. the third-subordinate sound chest 23 or the second-subordinate sound chest 22) should firstly be disposed at the bottom, then the next outside subordinate sound chest (e.g. the second-subordinate sound chest 22 or the first-subordinate sound chest 21) be disposed on the top of the most outside subordinate sound chest, and with the protrudent flange 27 of the next outside subordinate sound chest engages with the connection recess 24 of the most outside subordinate sound chest. Similar procedures are applied to other subordinate sound chest, and main sound case 10 is finally disposed on the top to form a pagoda shape overlap sound case assembly. The bottom wall of each sound case or sound chest has a sound discharge opening 12 or 26. The sound discharge opening should be formed at eccentric location of the bottom wall to prevent sound wave resonance vibration. The existing of sound discharge opening enlarges the resonance space of sound case and thereby enhance the low frequency resounding quality. Sound case can be easily assembled and has good hermetic property. Hermetic property can be further enhance by disposing padding or cloth at the connection location. Therefore it is easy to increase or change the height of the sound case in the present invention can produce good resounding quality and is very convenient. When in withdrawn and storage state, main sound case is disposed in the center and is well protected. When subordinate sound chest is damage, it is easy to get a replacement without the need to replace the whole set of sound case. Thus maintenance cost is lower than conventional one.

Furthermore, the sound discharge opening which being disposed eccentrically on the bottom wall of sound case or sound chest serves as channel for sound transmission. Sound, originates from main sound case, transmits downward to all subordinate sound chests to create resonance. Sound discharge opening can be a single hole or multiple holes. Sound discharge opening can also be disposed at the appropriated location on all walls of sound case or sound chest, such as front wall, rear wall or lateral walls, to achieve the sound transmission function.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A sound case comprising:

a main sound case generally formed as a box, said main sound case having a speaker and an electric circuit disposed therein, said main sound case further having a bottom wall with an opening therein, said bottom wall extending beyond side walls of said main sound case such that a flange is formed around a perimeter of said bottom wall, and plurality of subordinate sound chests of differing sizes, said subordinate sound chests each having a hollow interior, an open top side, a subordinate bottom wall with an opening therein, and surrounding side walls, said subordinate bottom walls of each subordinate sound chest extending beyond said side walls of each said subordinate sound chest such that a flange is formed around a perimeter of said subordinate bottom wall, said side walls of each said subordinate sound chest including a recess formed on a top side thereof; such that during operation said subordinate sound chests are stacked in order of decreasing size, each succeeding smaller subordinate sound chest being received in said recess on said top side of said side walls of a larger subordinate sound chest stacked beneath it, a smallest of said subordinate sound chests receiving said main sound case, and for storage, said main sound case is inverted and received top side down in the hollow interior of said smallest subordinate sound chest, said smallest subordinate sound chest thereafter being inverted and received top side down in a next larger subordinate sound chest, each succeeding subordinate sound chest being similarly stored in a next larger subordinate sound chest until all said subordinate sound chests and said main sound case are contained in a largest of said subordinate sound chests.

2. The sound case of claim 1 wherein:

said bottom wall of said main sound case and said subordinate bottom walls of said subordinate sound chests have multiple openings therein.

3. The sound case of claim 1 wherein:

said openings on said bottom wall of said main sound case and said subordinate bottom walls of said subordinate sound chests are disposed eccentrically.

4. A sound case comprising:

a main sound case generally formed as a box, said main sound case having a speaker and an electric circuit disposed therein, said main sound case further having an opening therein, said bottom wall extending beyond side walls of said main sound case such that a flange is formed around a perimeter of said bottom wall, and a plurality of subordinate sound chests of differing sizes, said subordinate sound chests each having an opening therein, a hollow interior, an open top side, a subordinate bottom wall, and surrounding side walls, said subordinate bottom walls of each subordinate sound chest extending beyond said side walls of each said subordinate sound chest such that a flange is formed around a perimeter of said subordinate bottom wall, said side walls of each said subordinate sound chest including a recess formed on a top side thereof; such that during operation said subordinate sound chests are stacked in order of decreasing size, each succeeding smaller subordinate sound chest being received in said recess on said top side of said side walls of a larger subordinate sound chest stacked beneath it, a smallest of said subordinate sound chests receiving said main sound case, and for storage, said main sound case is inverted and received top side down in the hollow interior of said smallest subordinate sound chest, said smallest subordinate sound chest thereafter being inverted and received top side down in a next larger subordinate sound chest, each succeeding subordinate sound chest being similarly stored in a next larger subordinate sound chest until all said subordinate sound chests and said main sound case are contained in a largest of said subordinate sound chests.

5. The sound case of claim 4 wherein:

said main sound case and said subordinate sound chests have multiple openings therein.

6. The sound case of claim 4 wherein:

said openings of said main sound case and said subordinate sound chests are disposed eccentrically.

* * * * *